United States Patent [19]

Albright

[11] Patent Number: 4,944,414

[45] Date of Patent: Jul. 31, 1990

[54] SHELF ASSEMBLY FOR VENDING TUBULAR PRODUCTS

[75] Inventor: Henry J. Albright, West Des Moines, Iowa

[73] Assignee: Fawn Engineering Corp., Des Moines, Iowa

[21] Appl. No.: 314,489

[22] Filed: Feb. 23, 1989

Related U.S. Application Data

[63] Continuation of Ser. No. 114,724, Oct. 30, 1987, abandoned, which is a continuation of Ser. No. 922,060, Oct. 22, 1986, abandoned.

[51] Int. Cl.[5] ..... A47F 7/00

[52] U.S. Cl. ..... 211/59.2; 211/59.3; 221/75

[58] Field of Search ..... 211/59.2, 59.3, 59.4, 211/49.1, 51; 221/75; 312/45

[56] References Cited

U.S. PATENT DOCUMENTS

| | | | |
|---|---|---|---|
| B 510,281 | 3/1976 | Cox et al. | 221/75 |
| 2,528,945 | 11/1950 | Carpenter | 221/75 X |
| 2,564,552 | 8/1951 | Verderey, Jr. | 221/75 |
| 2,954,128 | 9/1960 | Gordon | 211/59.3 |
| 2,954,129 | 9/1960 | Gordon | 211/59.3 |
| 3,110,402 | 11/1963 | Mogulescu | 211/59.3 |
| 3,986,637 | 10/1976 | Wittern et al. | 221/75 |
| 3,989,163 | 11/1976 | Wittern | 221/75 |

*Primary Examiner*—Reinaldo P. Machado
*Assistant Examiner*—Sarah A. Lechok
*Attorney, Agent, or Firm*—Henderson & Sturm

[57] ABSTRACT

An imposed shelf arrangement for vending tubular products such as cans and the like comprising a tray having a base, a rear panel and a pair of side panels or dividers forming a longitudinally disposed product feed trough having a width equal substantially to twice the length of a tubular product; a helix disposed centrally within said feed trough and adapted to receive a plurality of tubualr products between the convolutions thereof in a staggered relationship whereby the inner end of each tubular product is adapted to be disposed along the longitudinal axis of said trough; and a drive unit at the rear of the base for rotating said helix whereby to advance said tubular products one by one to the front edge of said base to drop to a delivery position.

2 Claims, 1 Drawing Sheet

SHELF ASSEMBLY FOR VENDING TUBULAR PRODUCTS

This is a continuation of copending application Ser. No. 114,724 filed on Oct. 30,1987 which is continuation Ser. No. 922,060 filed on Oct. 22, 1986 both abandoned.

TECHNICAL FIELD

The present invention relates generally to an article vending machine, and more particularly to an improved shelf or tray assembly for use therein, which improved shelf assembly is capable of vending tubular products side-by-side with packaged products.

BACKGROUND ART

Cabinet-type vending machines employing helical coils to selectively dispose numerous types of articles and packaged goods such as candies, nuts, chips and the like are old in the art. These mechanisms normally employ a plurality of vertically stacked, generally horizontally disposed and movable trays or shelves each of which usually has a plurality of front-to-rear generally rectangular troughs spaced laterally across the shelf and with a helical coil mounted in each trough. Such articles to be vended are positioned within convolutions of the coil such that, upon rotation of a particular coil in response to actuation of a control mechanism, one of the articles is projected into a delivery opening where it is available to a purchaser. In this type of arrangement, even though an end, e.g. of a package or wrapper may brush against the side of a wall or panel adjacent or preventing lateral movement of the product within the trough, such frictional drag to longitudinal feeding movement of the product does not lessen the efficiency of the structure.

Vending of tubular products, cans of soda, soup or the like present, however, a different problem. To place a row of cans within the convolutions of a helix for delivery similar to a package result in each can being canted or turned such that its longitudinal axis, its "rolling" axis is not normal or at right angles to the longitudinal axis of the trough. Thus tremendous friction forces are set up by each can vis-a-vis the floor and the sidewall of the trough, such that a conventional helix and drive motor are incapable of effectively handling such can or tubular product. The result has been the provision of serpentine racks for vending cans whereby pure gravity in most instances is used to deliver cans one-by-one to a delivery opening.

DISCLOSURE OF THE INVENTION

The invention relates to an improved shelf arrangement for a vending machine wherein each shelf includes a plurality of laterally spaced dividers forming, with the sides of the shelf a plurality of longitudinally extended troughs, with a helical feeding coil disposed within each trough having a drive mechanism mounted at the rear of the shelf for selectively operating one or more of said coils; and with the width of a trough sufficient, as by having for example a divider removable, and the size of a coil sufficient to receive a plurality of cans or tubular-type products arranged in two rows and interspersed in a staggered relationship witin the conVolutions of a single helix, with the outer ends of each row of cans contiguous with a divider or sidewall and with a portion of the inner end of each can contacting in a flat manner a portion of each opposite staggered can, and with the longitudinal axis of the cans normal to the longitudinal axis of the said trough.

It is an object of the invention to provide an improved shelf arrangement for vending tubular products.

It is another object of this invention to provide an improved shelf arrangement for vending packaged products alongside tubular products without the need of special equipment.

Yet another object of this invention is to vend tubular products on a flat tray from the rear of the tray to the front thereof by the use of a conventional helix normally used to vend packaged products.

Still another object of this invention is to place a plurality of cans or like tubular products in two rows of staggered cans with a single helical coil in contact with each can for rolling movement purposes, with the can maintained in rows the longitudincal axis of each which is normal to the longitudinal axis of the can.

BRIEF DESCRIPTION OF THE DRAWINGS

These and other objectives of the invention will become readily apparent upon a thorough study and review of the following detailed description of the preferred embodiment for carrying out the invention, particularly when viewed in conjunction with the accompanying drawings, wherein.

BEST MODE FOR CARRYING OUT THE INVENTION

This invention relates to an improved shelf assembly involving helical coil vending of the type machine shown in co-pending application Ser. No. 06/899,651 entitled "VENDING MACHINE SHELF ASSEMBLY", and assigned to the Assignee of the present application. The above-mentioned patent application is incorporated by reference with regard to the details of the vending machine shown and described therein; however, the vending machine will be described herein so far as pertinent to a background for and understanding of this application's invention.

Figure 2:
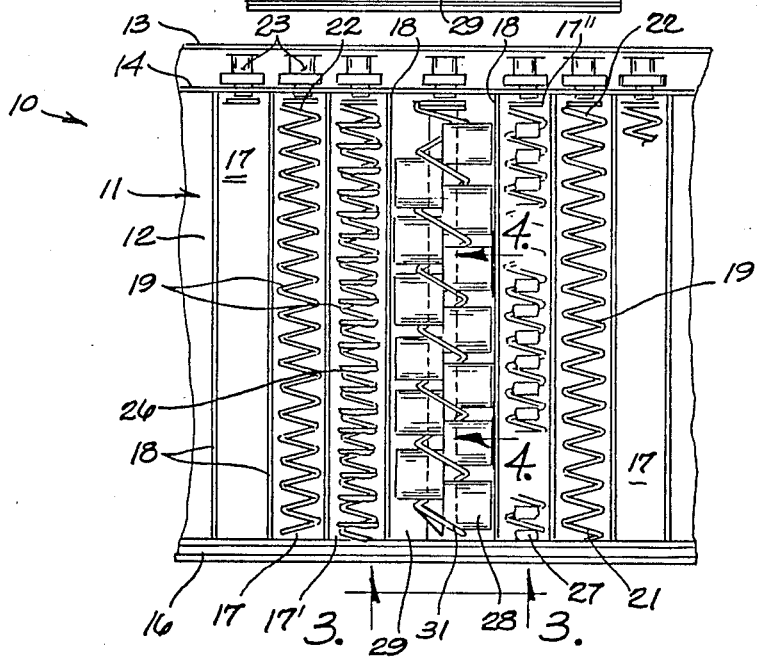
FIG. 2 is a plan view of the improved shelf arrangement of this invention showing centrally thereof the particular tubular product vending arrangement.

Referring to FIG. 2, one shelf of the vending machine of this invention is generally indicated at (10). The vending machine has a substantially rectangular housing closed by an openable front door. A plurality of shelves identical to the shelf (10) are vertically located in a spaced apart orientation in the housing. The construction of each shelf is generally similar so that a description of one shelf (10) will suffice to describe the others.

The shelf assembly (10) comprises a three-sided tray (11) having a substantially horizontal base or support surface (12) with an upwardly extended rear wall (13), an upwardly extended rear panel (14) forwardly of and parallel the rear wall (13), sidewalls (not shown) and a front edge (16) extended parallel the rear wall (13).

The tray (11) is divided into a plurality of product receiving channels or troughs (17) by a plurality of longitudinal vertical walls or dividers (18). The dividers run the entire length of the base (12) from the rear panel (14) to the front edge (16). The dividers (18) are laterally spaced apart a sufficient distance to define a trough (17) in which a first normal size elongated helical coil (19) is received. Each helical coil (19) has a plurality of convolutions and a generally circular cross-section. Each coil (19) terminates near the edge (16) of the base (12) in a discharge end (21) and at the rear end of the tray (11) adjacent to the rear panel (14) in a driven end (22). The front edge (16) of the tray (11) and the discharge ends (21) of the coils (19) are appropriately spaced inwardly from the front door of the vending machine to provide a discharge space in which food products can be vended.

A separate drive unit (23) is provided for rotating each of the helical coils (19) in a direction to allow dispensing of the food products received between the convolutions thereof. Each drive unit (23) is secured in one manner or another to the rear panel (14), and has a shank (not shown) which extends through the rear panel (14) and into driving engagement with the driven end (22) of the coil (19). The driven ends (22) of each coil (19) have any suitable means for releasably attaching to the shank of the drive unit (23).

One particular way of mounting the drive unit (23) on the rear panel (14) comprises the provision of the rear panel (14) having a plurality of vertically disposed, horizontally spaced slots (24) formed therein, each slot (24) open at the top and closed at the bottom of the rear panel (14). Thus, each drive unit (23) is removably, slideably mounted into any one of the slots (24) as is best shown in FIG. 3.

Figure 3:
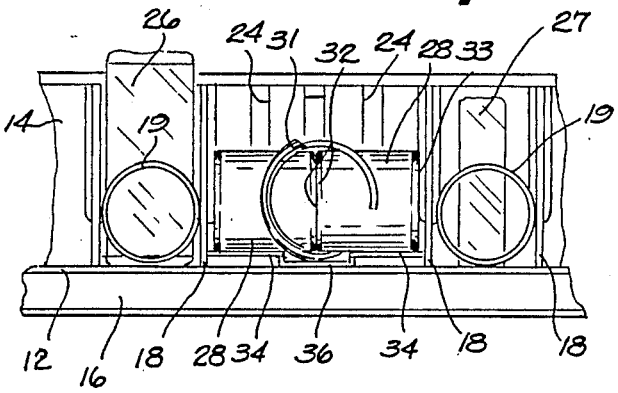
FIG. 3 is a front elevational view taken along line 3—3 of FIG. 2.

Referring to FIGS. 2 and 3, the trough (17′) is shown carrying a plurality of soft packages (26) of food, the packages being interspersed in the normal manner between the convolutions of the particular coil (19) drivingly mounted therein. Further, another trough (17″) has interspersed between the convolutions of the coil (19) therein, a plurality of smaller, more hard packages (27), such as candy bars and the like.

Using the type of trough as (17′) or (17″) with a helical coil (19), it has been impossible to vend effectively tubular products such as cans (28) of soup, for example. They do not lend themselves to being interspersed between the convolutions of a coil (19), and should they be forced into that configuration they cant or incline relative to a normal longitudinal movement within the trough (17) such that their corners are continually driven up against either or both dividers (18) on either side thereof, the result being a constant jamming of the cans at least, and at best a very ineffective and inefficient operation.

Figure 1:
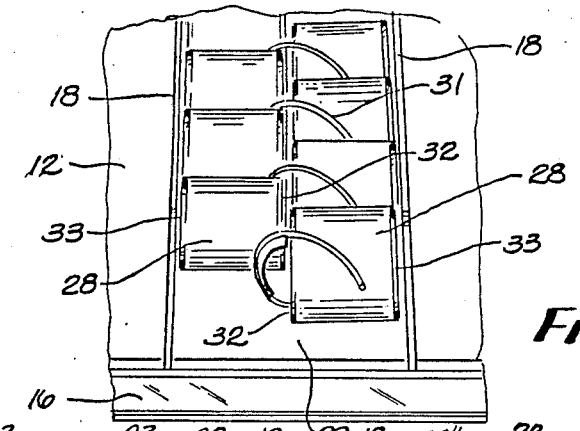
FIG. 1 is a front perspective view of a detail part of a shelf arrangement showing two rows of staggered tubular products between a pair of panels and positioned within a drive helix.
Figure 4:
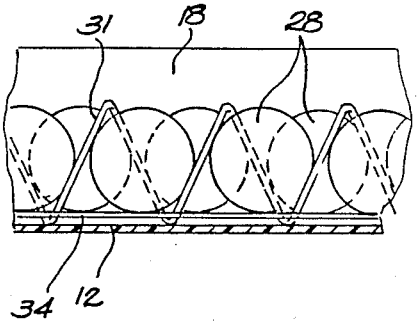
FIG. 4 is a side elevational view taken along line 4—4 in FIG. 2.

The present invention comprises removing one of the dividers (18) to provide a trough (29) having a width substantially equal to the length of two cans (28) or twice the length of one can (28). A slightly larger helical coil (31) is provided, although the same helix (19) as used for products (26), (27) is useable if stretched, being disposed centrally of the trough (29) and which is adapted to receive a plurality of the cans (28) between its convolutions, as shown in FIGS. 1 and 4, in a staggered relationship with the inner end (32) of each can (280 adapted to be disposed along the longitudinal axis of trough (29), and in this regard the inner ends (32) form an imaginary line of engagement extended parallel the dividers (18).

Further, the arrangement is such that the outer ends (33) of the can products (28) are adapted to engage a respective one of the dividers (18) defining the trough (29). Each can (28) is engaged by at least one portion of each convolution of the helical coil (31), when loaded as illustrated, such that the cans (28) are maintained in the spaced relationship as best shown in FIG. 2; and as shown in FIG. 4, a front and rear portion of each can (28) can be in contacting relationship with the coil (31). Additionally, this arrangement places the longitudinal axis of each can (28) normal to the longitudinal axis of the trough (29) whereby the cans (28) roll freely, as maintained by the coil (32), in a straight line on their perpheral surface toward the front edge (16) of the tray (11) for discharge to the delivery area of the vending machine.

Further yet, it will be noted that each inner end (32) of each can (28) is engaged in a flat or full manner with at least a portion of each inner end (32) of the two adjacent opposite cans (28), unless at the front or rear of the group.

To maintain the coil (31) centered within the trough (29), a subfloor may be provided comprising a pair of elevated side members (34) with a depressed central portion (36), the coil (31) nested within the central portion.

Various modifications of this invention will be apparent to those skilled in the art. Obviously the size of the trough (29) and of the coil (31) can vary widely as long as they function to maintain any group of tubular products having a common shape and size in the staggered, spaced and contacting relationship as shown and described herein. Therefore, the scope of this invention should be limited only by the appended claims.

I claim:

1. In a vendor comprising a cabinet having a front door, at least one shelf in the cabinet, the forward end of the shelf being spaced rearward from the door to provide a discharge space, a helix on the shelf extending in rear-to-front direction with respect to the cabinet and adapted to receive tubular items to be vended between its convolutions, the items being interiorly unobstructed so that the items may be received between its convolutions extending across the helix from one side thereof to the other, means for rotating the helix to advance the items toward the forward end of the shelf and discharge the forwardmost item off the forward end of the shelf to drop down into the discharge space, and panels extending in rear-to-front direction on the shelf at opposite sides of the helix defining a path of travel for the items, the improvement comprising the provision of placing the helix at midpoint between the panels, the panels being spaced a distance to accommodate the width of a pair of items to be dispensed placed end-to-end between the panels, the panels being so located relative to the helix that the items are supported at their outer ends by the panels and at their inner ends by each other, the portion of the convolutions of the helix on one side of the longitudinal center thereof being capable of supporting one rear-to-front row of tubular items, and the portions of the convolutions of the helix on the other side of the longitudinal center thereof being capable of supporting another rear-to-front row of tubular items in a relationship staggered relative to said one rear-to-front row, whereby the helix is capable of supporting the tubular items in a staggered relationship, thereby providing a forwardmost item for discharge alternately from each row.

2. In a vendor as set forth in claim 1, the panels being so located relative to the helix, and the helix having a diameter approximately half the spacing of the panels that each convolution of the helix is adopted to embrace portions of a pair of items supported end-to-end and in a laterally staggered relationship.

* * * * *